US007419296B2

(12) United States Patent
Allen

(10) Patent No.: US 7,419,296 B2
(45) Date of Patent: Sep. 2, 2008

(54) GEL MIXING SYSTEM

(75) Inventor: Thomas E. Allen, Tulsa, OK (US)

(73) Assignee: Serva Corporation, Wichita Falls, TX (US)

( * ) Notice: Subject to any disclaimer, the term of this patent is extended or adjusted under 35 U.S.C. 154(b) by 539 days.

(21) Appl. No.: 11/113,727

(22) Filed: Apr. 25, 2005

(65) Prior Publication Data

US 2005/0185506 A1 Aug. 25, 2005

Related U.S. Application Data

(63) Continuation-in-part of application No. 10/426,742, filed on Apr. 30, 2003, now abandoned.

(51) Int. Cl.
*B01F 15/00* (2006.01)
*B01F 15/02* (2006.01)

(52) U.S. Cl. ..... 366/164.6; 366/182.2; 366/290

(58) Field of Classification Search ..... 366/164.6, 366/177.1, 160.1, 160.2, 167.1, 182.1, 182.2, 366/290

See application file for complete search history.

(56) References Cited

U.S. PATENT DOCUMENTS 3,542,342 A 11/1970 Barron
3,779,518 A * 12/1973 Koepke et al. ..... 366/152.3
4,125,331 A 11/1978 Chisholm
4,233,265 A * 11/1980 Gasper ..... 422/135
4,241,023 A * 12/1980 Wilke et al. ..... 422/187
4,334,884 A * 6/1982 Wilke et al. ..... 23/293 R
4,688,945 A 8/1987 Brazelton et al.
4,838,701 A 6/1989 Smith et al.
4,952,066 A * 8/1990 Hoffland ..... 366/160.2
5,046,856 A 9/1991 McIntire
5,064,582 A 11/1991 Sutton et al.
5,103,908 A 4/1992 Allen
5,135,968 A 8/1992 Brazelton et al.
5,190,374 A 3/1993 Harms et al.
5,382,411 A 1/1995 Allen
5,383,725 A 1/1995 Swisher, Jr. et al.
5,426,137 A 6/1995 Allen (Continued)

OTHER PUBLICATIONS

T.E. Allen, Pregel Blender Prototype Designed to Reduce Cost and Environmental Problems SPE 27708, This paper was prepared for presentation at the 1994 SPE Permian Basin Oil and Gas Recovery Conference held in Midland, Texas, Mar. 16-18, 1994.

*Primary Examiner*—Tony G Soohoo
(74) *Attorney, Agent, or Firm*—McAfee & Taft

(57) ABSTRACT

A gel mixing system that employs a dynamic diffuser for quickly removing the air from the fluid as the fluid exits a traditional gel mixer and employs progressive dilution of the gel in a series of hydration tanks to maximize hydration time without allowing the gel to become so viscous that it is not easily diluted or pumped. High shear agitation of the fluid between the hydration tanks helps to increase the hydration rate. Progressive dilution of the gel increases residence time of the gel in the tanks and results in longer hydration time in the limited tank space available, resulting in continuous production of gel that is almost fully hydrated when it is pumped to the fracturing blender and subsequently to the well bore without the need for an increase in the volume of the hydration tanks.

19 Claims, 6 Drawing Sheets

U.S. PATENT DOCUMENTS 5,981,446 A 11/1999 Qiu et al.
6,027,240 A 2/2000 Han
6,644,844 B2 * 11/2003 Neal et al. ..... 366/10
6,817,376 B2 * 11/2004 Morgan et al. ..... 137/14
7,223,013 B2 * 5/2007 Allen ..... 366/303
2004/0218463 A1 * 11/2004 Allen ..... 366/164.6
2007/0114035 A1 * 5/2007 Parris et al. ..... 166/300

* cited by examiner

Fig. 11

| Tank No. | Mixing/dilution rate (bpm) | throughput rate (bpm) | conc. (lb/1000) | added residence time (min.) | total residence time (min.) | estimated gel strength (%) | estimated gel strength (cp) |
|---|---|---|---|---|---|---|---|
| 1 | 14 | 14 | 125.00 | 2.86 | 2.86 | 66.35 | 78.19 |
| 2 | 5 | 19 | 92.11 | 2.11 | 4.96 | 83.33 | 72.37 |
| 3 | 4 | 23 | 76.09 | 1.74 | 6.70 | 90.28 | 64.77 |
| 4 | 27 | 50 | 35.00 | 0.80 | 7.50 | 93.12 | 30.73 |

Fig. 12

| Tank No. | Mixing/dilution rate (bpm) | throughput rate (bpm) | conc. (lb/1000) | added residence time (min.) | total residence time (min.) | estimated gel strength (%) | estimated gel strength (cp) |
|---|---|---|---|---|---|---|---|
| 1 | 8.4 | 8.4 | 125.00 | 4.76 | 4.76 | 82.28 | 96.97 |
| 2 | 3.0 | 11.4 | 92.11 | 3.51 | 8.27 | 96.17 | 83.52 |
| 3 | 2.4 | 13.8 | 76.09 | 2.90 | 11.17 | 100.00 | 71.74 |
| 4 | 16.2 | 30.0 | 35.00 | 1.33 | 12.50 | 100.00 | 33.00 |

Fig. 13

| Tank No. | Mixing/dilution rate (bpm) | throughput rate (bpm) | conc. (lb/1000) | added residence time (min.) | total residence time (min.) | estimated gel strength (%) | estimated gel strength (cp) |
|---|---|---|---|---|---|---|---|
| 1 | 14 | 14 | 75.00 | 2.86 | 2.86 | 66.35 | 46.92 |
| 2 | 5 | 19 | 55.26 | 2.11 | 4.96 | 83.33 | 43.42 |
| 3 | 4 | 23 | 45.65 | 1.74 | 6.70 | 90.28 | 38.86 |
| 4 | 7 | 30 | 35.00 | 1.33 | 8.03 | 95.18 | 31.41 |

GEL MIXING SYSTEM

CROSS-REFERENCE TO RELATED APPLICATIONS

This is a continuation in part application of U.S. patent application Ser. No. 10/426,742 entitled Gel Mixing System that was filed on Apr. 30, 2003 now abandoned.

BACKGROUND OF THE INVENTION

1. Field of the Invention

The present invention relates to a system for continuously mixing gel fluid that will be used to transport fracturing proppant into a well formation to prop open the formation after fracturing. The system employs a dynamic diffuser to remove air from the fluid as the fluid leaves the dynamic diffuser and travels through a series of hydration tanks. High shear agitation is used to help mix the gel fluid and dilution fluid as it moves through the hydration tanks. This system allows increased hydration time and more complete hydration of the gel fluid in the limited tank space of skid, truck, or trailer mounted portable equipment than is possible with current gel mixing systems.

2. Description of the Related Art

Currently when mixing guar powder and water to form a liquid gel for use to transport fracturing proppant into a well formation, the mixing is done by a portable mixer and one or more portable hydration tanks. All of the equipment necessary to mix the gel is skid, truck, or trailer mounted so that it can be transported to the well site. There at the well site, the gel is constantly mixed, transferred to the fracturing blender, and pumped into the well bore. Because the equipment is truck or trailer mounted, the tank volume available for allowing the gel to hydrate after it is mixed with water is limited.

One of the problems with current gel mixing systems is that, without the use of large hydration tanks, the gel is not fully hydrated to the desired viscosity before the gel is transferred to the fracturing blender. Large hydration tanks can not be readily skid, truck or trailer mounted for use at a well site. Without using large hydration tanks, the gel will have a short residence time of the liquid within the smaller skid, truck or trailer mounted hydration tanks which does not allow sufficient time for the gel to become adequately hydrated before it is transferred to the fracturing blender prior to being used in the well.

The present invention addresses these problems by creating a gel concentrate, employing a dynamic diffuser for quickly removing the air from the fluid as the fluid exits the gel mixer, and by progressively diluting the gel concentrate in a series of hydration tanks to maximize hydration time without allowing the gel to become so viscous that it is not easily diluted or pumped. High shear agitation of the fluid between the hydration tanks also helps to increase the hydration rate. By progressively diluting the gel concentrate, residence time and hydration time are maximized in the limited tank space. The result of this new continuous gel mixing system is that the gel is almost fully hydrated when it is transferred to the fracturing blender without the need for an increase in the volume of the hydration tanks.

Some gels hydrate faster than others. This system is useful for both standard gels and fast hydrating gels. With fast hydrating gels, the system can be operated at a higher throughput rate, thus extending the usefulness of the system.

One object of the present invention is to provide a system that continuously mixes guar powder with water to produce a gel.

A further object to the invention is to provide a system that employs high sheer pumps that allow the guar to hydrate into a viscous gel more quickly than prior art systems. When dry guar powder is mixed with water, a thick gelatinous coating is formed around each of the particles of the dry powder as the powder begins to hydrate at its surface. These partially hydrated particles may be called micelles. They are relatively dry in their nucleus and are progressively more fully hydrated at their surface. The high sheer pumps used in the present system tend to disrupt or sheer this gelatinous outer coating off of the micelles. This allows the dryer inner portions and nucleus of the micelles to be contacted with water more quickly, thereby speeding up the hydration process.

Another object of the invention is to increase the hydration time of the gel within the limited hydration tank space.

Still a further object of the invention is to provide a system that does not require special chemicals such as non-aqueous carrying fluids, suspending agents, and dispersing agents for the process. By not requiring special chemicals, some of which are considered harmful to the environment, the end gel product is more economical and more environmentally friendly.

A final object of the present invention is to employ mobile equipment such that the equipment would be truck or trailer mounted and the gel would be produced at or near the well site using the truck or trailer mounted equipment.

SUMMARY OF THE INVENTION

The present invention is a gel mixing system that employs a dynamic diffuser for quickly removing the air from the fluid as the fluid exits a traditional gel mixer and employs progressive dilution of a concentrate fluid as it hydrates into a gel in a series of hydration tanks to maximize hydration time without allowing the gel to become so viscous that it is not easily pumped. High shear agitation of the fluid between the hydration tanks helps to increase the hydration rate. Progressive dilution of a concentrate gel in the hydration tanks increases residence time of the gel in the tanks and results in longer hydration time in the limited tank space available. As a result, the present system is able to continuously produce gel that is almost fully hydrated by the time it is transferred to the fracturing blender without the need for an increase in the volume of the hydration tanks.

BRIEF DESCRIPTION OF THE DRAWINGS

FIG. 11 is a chart showing an example of a mixing system using progressive dilution to produce a constant 50 bpm throughput at a guar concentration of 35 lb/100 gal. of water.

FIG. 12 is a chart showing the results of reducing the throughput to 30 bpm in the mixing system of FIG. 11 but where dilution is proportionally changed in all tanks in comparison to FIG. 11 so that a fixed original concentration is maintained in all dilution tanks.

FIG. 13 is a chart showing the results of reducing the throughput to 30 bpm in the mixing system of FIG. 11 where dilution is controlled by viscometer readings and computer so that the original total hydration time is approximately maintained and the maximum viscosity in the process is limited, with the maximum viscosity being about 50% of that shown in FIG. 12.

DETAILED DESCRIPTION OF THE PREFERRED EMBODIMENT

INVENTION

Figure 1:
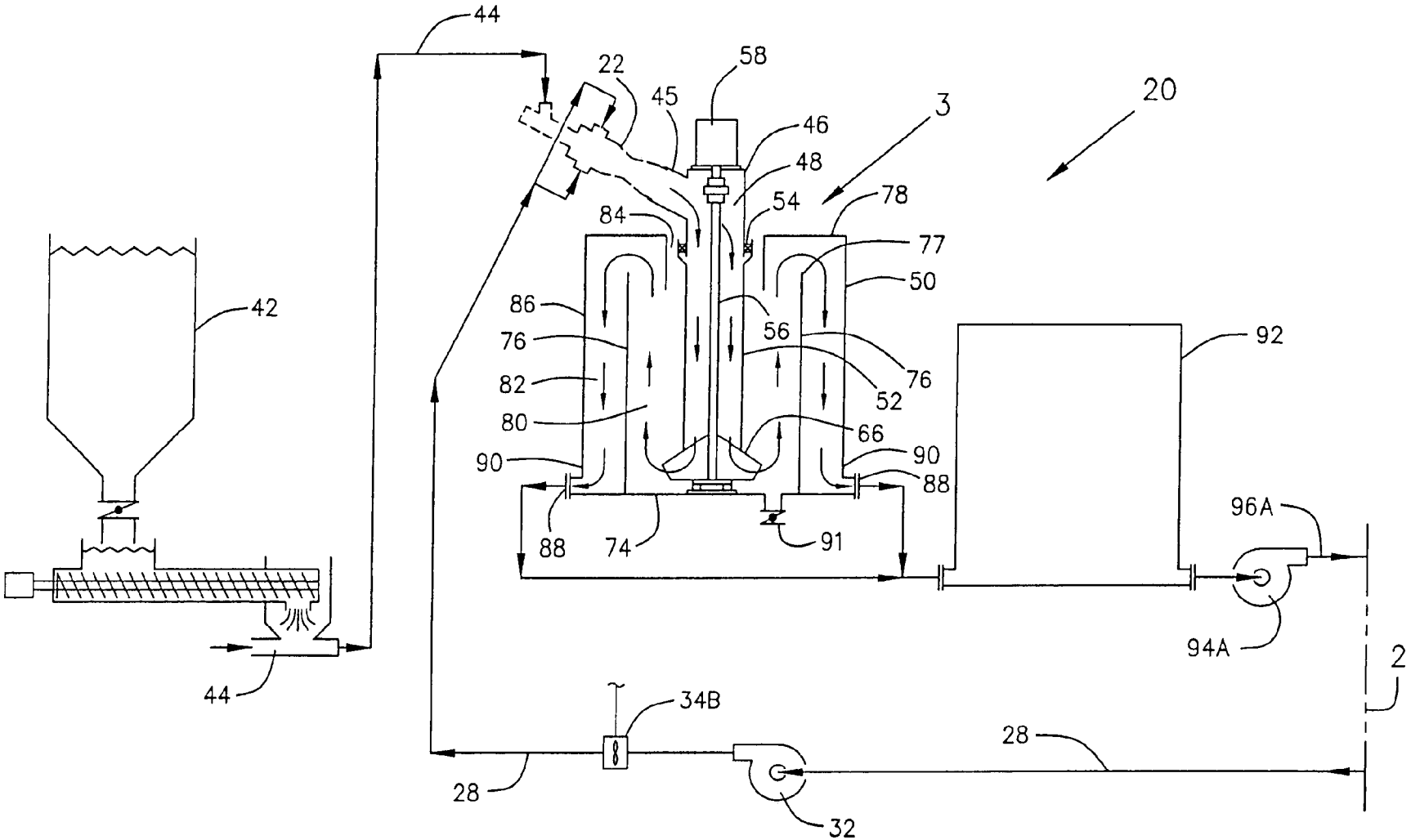
FIGS. 1 and 2 are a diagram of a gel mixing system constructed in accordance with a preferred embodiment of the present invention.
Figure 2:
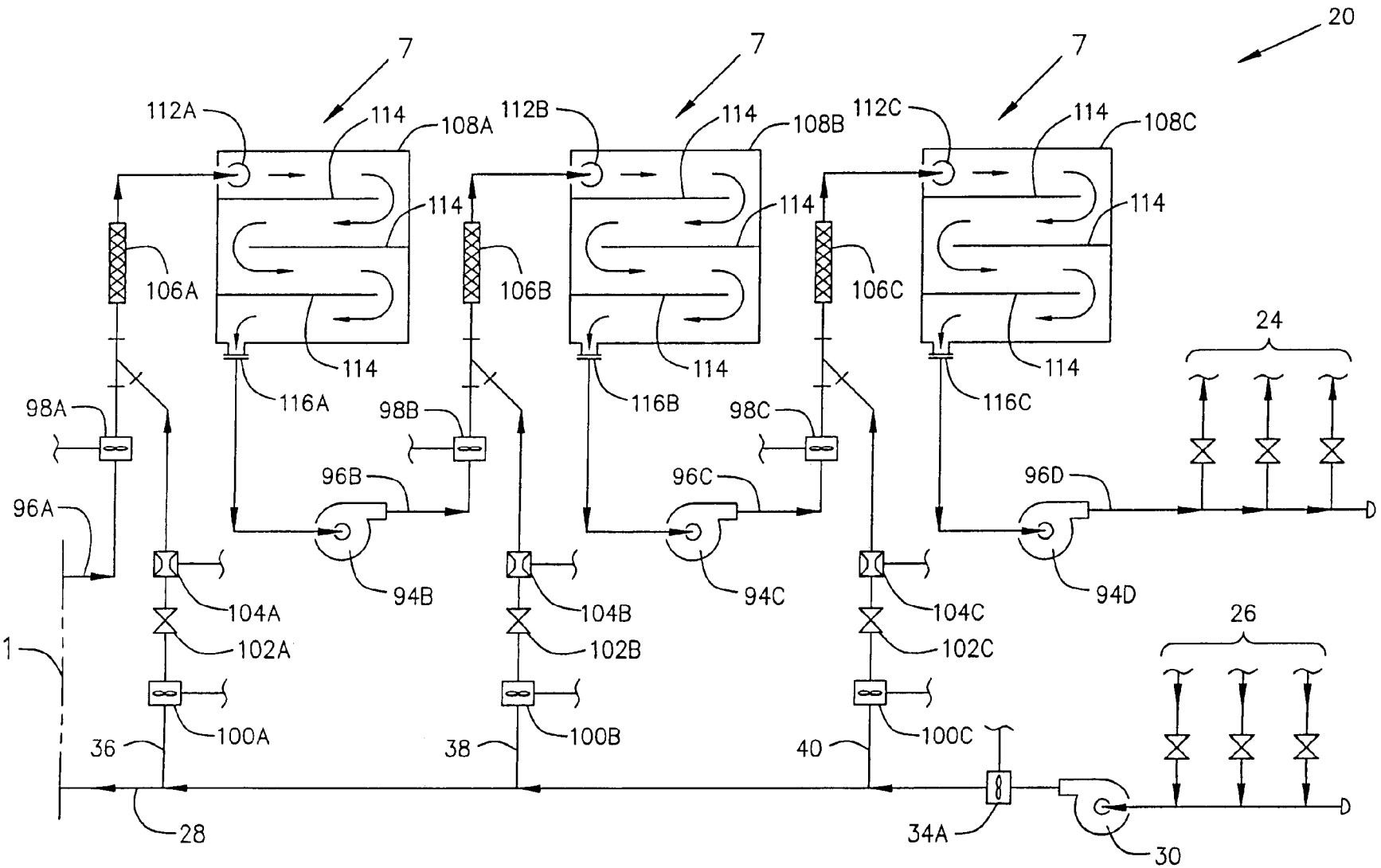

Referring now to the drawings and initially to FIGS. 1 and 2, there is shown a diagram of a gel mixing system 20 constructed in accordance with a preferred embodiment of the present invention. Upstream of the system 20, a gel mixer 22 such as the type taught by U.S. Pat. No. 5,382,411, issued on Jan. 17, 1995 to the present inventor, supplies liquid gel mixture to the system 20. Downstream of the system 20, the system 20 supplies hydrated gel to a gel discharge manifold 24 which in turn supplies the hydrated gel to a fracturing blender where sand or other proppant and chemicals are blended with the hydrated gel before the mixture is pumped to a well bore. The fracturing blender is not illustrated in the drawings.

As illustrated in FIGS. 1 and 2, a suction manifold 26 supplies dilution water to the gel mixer 22 via mixer dilution water line 28 and water pumps 30 and 32. Mix water flow meters 34A and 34B are provided in mixer dilution water line 28. Mix water flow meter 34A measures the total flow of dilution water supplied to the system 20 by the suction manifold 26, and mix water flow meter 34B measures the flow of mixer dilution water supplied specifically to the mixer 22. In addition to supplying mixer dilution water to the mixer 22, the suction manifold 26 also supplies dilution water to the system 20 via first, second, and third dilution water lines 36, 38, and 40, respectively.

Figure 4:
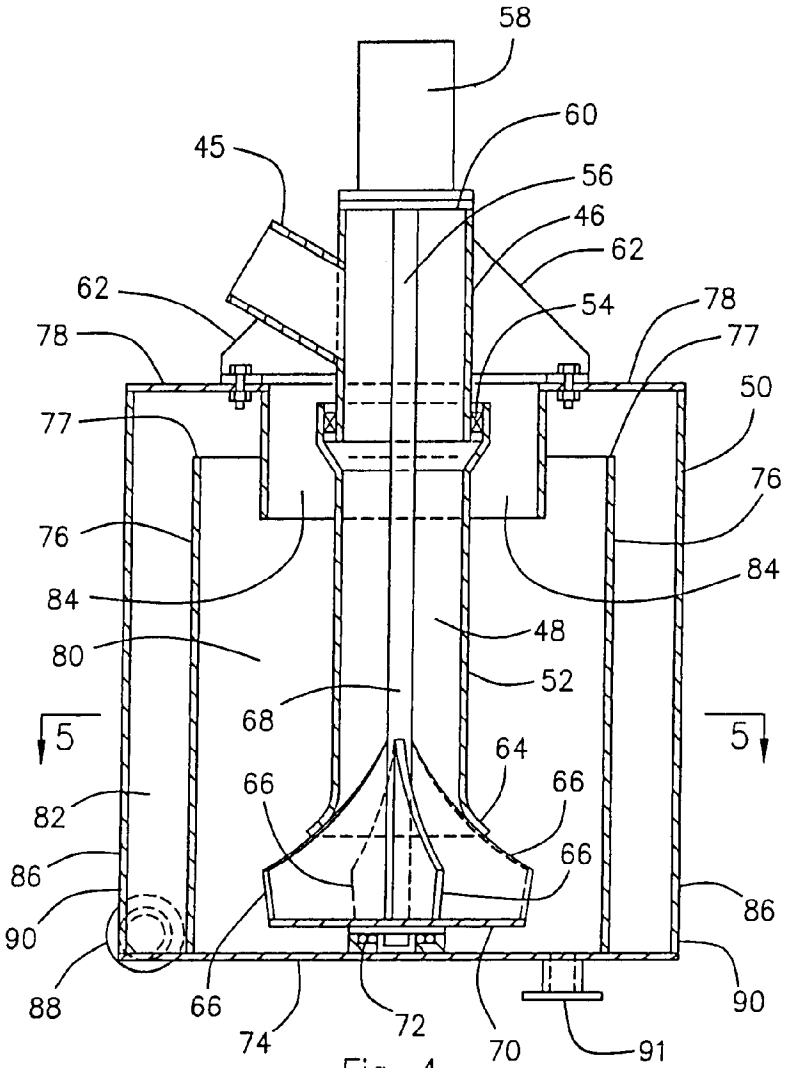
FIG. 4 is a cross sectional view of the dynamic diffuser taken along line 4-4 of FIG. 3.

Also, as illustrated in FIG. 1, dry gel powder is metered out of a gel supply tank 42 and transported via vacuum line 44 from the gel supply tank 42 to the gel mixer 22 where the dry gel powder is then mixed with the water supplied by mixer dilution water line 28 to form a liquid gel concentrate which is continuously delivered via an inlet pipe 45, shown in FIG. 4, into a stationary upper portion 46 of an impeller cylinder 48 located centrally within a dynamic diffuser tank 50.

Figure 3:
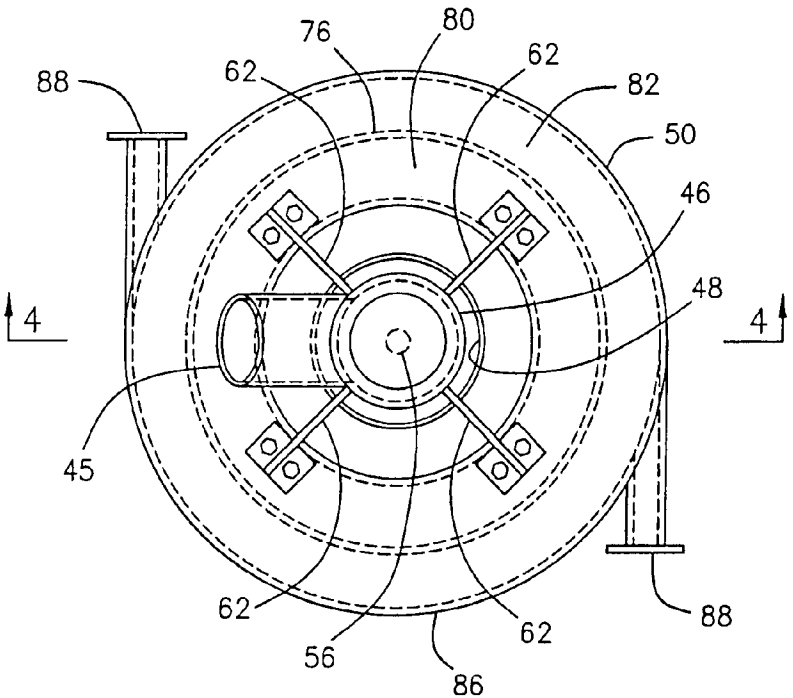
FIG. 3 is a top plan view of the active or dynamic diffuser of FIG. 1, as indicated in FIG. 1 by arrow 3.
Figure 5:
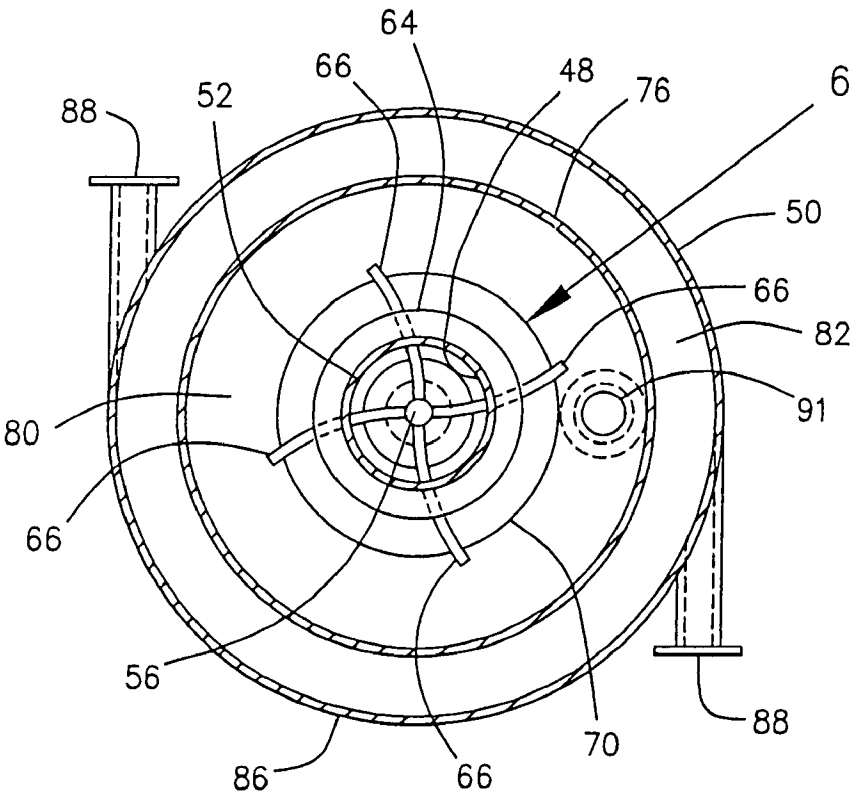
FIG. 5 is a cross sectional view of the dynamic diffuser taken along line 5-5 of FIG. 4.
Figure 7:
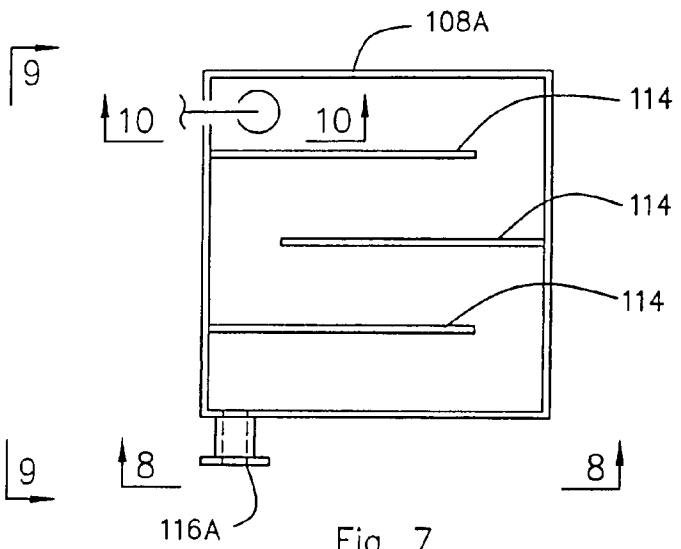
FIG. 7 is a top view of one of the hydration tanks of FIG. 2, as indicated in FIG. 2, by arrows 7.
Figure 8:
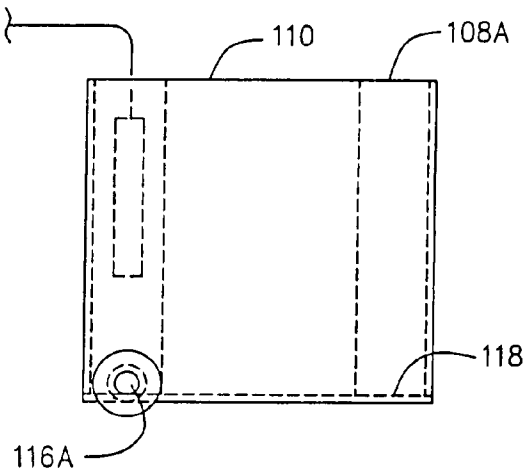
FIG. 8 is a front view of a hydration tank taken along line 8-8 of FIG. 7.
Figure 9:
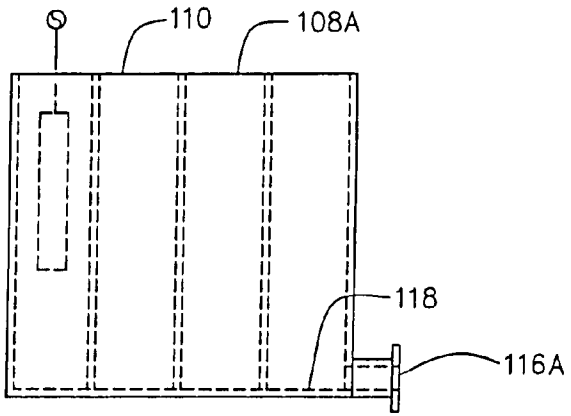
FIG. 9 is a side view of a hydration tank taken along line 9-9 of FIG. 7.
Figure 10:
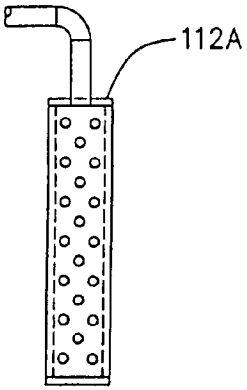
FIG. 10 is an enlarged view of a static mixer of the hydration tank taken along line 10-10 of FIG. 7.

Referring now to FIGS. 4 and 5, a lower portion 52 of the impeller cylinder 48 attaches to the stationary upper portion 46 via bearings 54 so that the lower portion 52 of the impeller cylinder 48 rotates in conjunction with the rotation of a high speed impeller shaft 56 that extend longitudinally through the impeller cylinder 48. The impeller 56 and the lower portion 52 of the impeller cylinder 48 are rotated by an impeller motor 58 located on the top 60 of the stationary upper portion 46. As best illustrated in FIGS. 3 and 4, the impeller motor 58, the inlet pipe 45, and the upper stationary portion 46 of the impeller cylinder 48 are all held stationary relative to the dynamic diffuser tank 50 via support arms 62 that secure them to the dynamic diffuser tank 50, as best shown in FIG. 3.

Figure 6:
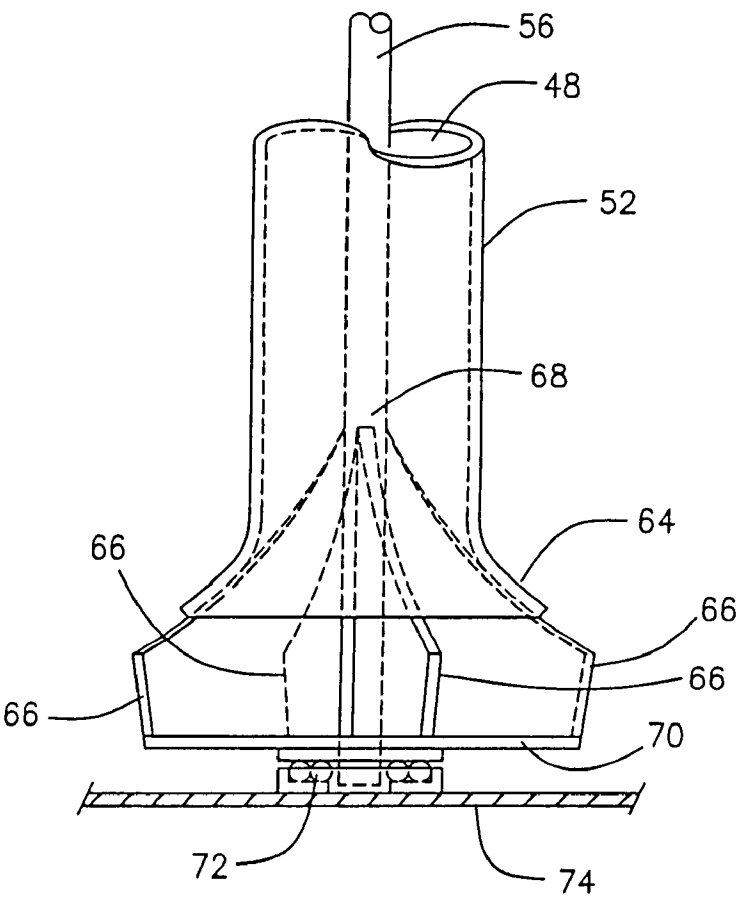
FIG. 6 is a side view of a lower end of an impeller for the dynamic diffuser of FIG. 5, as indicated in FIG. 5 by arrow 6.

Referring also to FIGS. 5 and 6, the impeller shaft 56 extends downward through the upper and lower portions 46 and 52 of the impeller cylinder 48 and secures to the flared bottom 64 of the lower portion 52 of the impeller cylinder 48 via radiating vertical fins 66 provided at the lower end 68 of the impeller 56. Although the fins 66 have been illustrated as being vertical, they are not so limited and may be spiral like an auger instead, with a pitch velocity approximately equal to the mixer discharge velocity. The lower end 68 of the impeller 56 is provided with a bottom plate 70. A second set of bearings 72 are provided on the bottom plate 70 to support the bottom plate 70 above the bottom 74 of the dynamic diffuser tank 50.

Referring now to FIGS. 1 and 2, the purpose of the dynamic diffuser 50 is two fold. The dynamic diffuser 50 pulls mixture away from the gel mixer 22 so that there is no back pressure on the mixer 22 and therefore no moisture accumulates within the mixer 22 and the possible build up of gel and water within the mixer 22 is avoided. Also, the dynamic diffuser 50 serves to quickly remove air from the gel fluid as the fluid exits the gel mixer 22. Air is conveyed into the fluid stream by the mixer 22. Most mixers 22 create a vacuum at the entrance of the mixer 22. This vacuum sucks air into the mixer 22 and subsequently into the fluid stream. Also, the guar powder will tend to convey some air with it into the mixing fluid.

The dynamic diffuser 50 pulls the moisture away from the mixer 22 and removes the air by using a high speed rotating impeller 56 that causes the liquid to travel down through the impeller cylinder 48 and to be propelled radially outward at the lower end 68 of the impeller shaft 56. Liquid entering the dynamic diffuser 50 via the inlet pipe 45 provided in the stationary upper portion 46 of the impeller cylinder 48 travels downward between the impeller shaft 56 and the lower portion 52 of the impeller cylinder 48 to the bottom plate 70. From there, the fins 66 on the lower end 68 of the impeller 56 force the liquid horizontally outward so that the liquid exits the impeller cylinder 48 at the flared bottom 64 of the lower portion 52 of the impeller cylinder 48 and strikes against an internal partition wall 76 provided within the dynamic diffuser tank 50. The internal partition wall 76 is cylindrical in shape and secured to the bottom 74 of the dynamic diffuser tank 50. A top 77 of the wall 76 does not extend to the top 78 of the dynamic diffuser tank 50. Thus, the internal partition wall 76 separates the tank 50 into two channels 80 and 82 that connect with each other above the top 77 of the internal partition wall 76. Channel 80 is located outside of the impeller cylinder 48 and between the impeller cylinder 48 and the internal partition wall 76. Channel 82 is located outside the internal partition wall 76 and between the internal partition wall 76 and an outside wall 86 of the dynamic diffuser tank 50.

The air that enters the dynamic diffuser tank 50 with the liquid gel is not propelled outward with the liquid, but rather travels upward within channel 80 where it exits the dynamic diffuser through air exit openings 84 provided in the top 78 of the tank 50 and located just outside the stationary portion 46 of the impeller cylinder 48. The liquid moves through the dynamic diffuser 50 by first traveling upward within channel 80, next traveling over the partition wall 76, and then traveling downward within the channel 82. Arrows inside the dynamic diffuser shown in FIG. 1 illustrate this flow path. Finally, the liquid exits the dynamic diffuser 50 at liquid exits 88 provided at the bottom 90 of the outside wall 86 of the dynamic diffuser 50. The dynamic diffuser 50 is also provided with a clean out opening 91 located in the bottom 74 of the dynamic diffuser 50.

The liquid that exits the dynamic diffuser 50 then enters a first hydration tank 92, shown in FIG. 1. The purpose of the first hydration tank 92 is to provide a volume in which the gel begins to hydrate.

Although this first hydration tank 92 is shown separated from the dynamic diffuser tank 50, in practice this first hydration tank 92 may be large enough to completely enclose the dynamic diffuser tank 50 so that the liquid flows directly out of the dynamic diffuser tank 50 into this first hydration tank 92.

The liquid is pumped out of this first hydration tank 92 via a first centrifugal high sheer pump 94A through a first liquid flow line 96A. Each of the centrifugal high sheer pumps 94A, 94B, 94C, and 94D employed in this system 20 increases the hydration rate of the liquid gel. The more inefficient the pump 94A, 94B, 94C, and 94D, the more sheer or disruption occurs in the gel micelles. This helps break down the partially hydrated gel particles or micelles and thus speeds up the hydration process. The first liquid flow line 96A is provided with an first liquid flow meter 98A and intersects with a first dilution water line 36 where the liquid is diluted with water supplied by the first dilution water line 36. The first dilution water line 36 receives water from the suction manifold 26. The water flowing through this first dilution water line 36 flows through a first water flow meter 100A, a first on/off butterfly valve 102A, and a first proportional valve 104A that controls the flow of water through the first dilution water line 36. The mixture of liquid from first liquid flow line 96A and water from the first dilution water line 36 passes through a first static mixer 106A where the liquid and water are mixed to dilute the liquid.

Referring now also to FIGS. 7, 8, 9, and 10, the mixture then enters the second hydration tank 108A at the top 110A of the tank 108A via a first passive diffuser 112A that slows down the velocity of the fluid as it enters the tank 108A. Each of the hydration tanks 108A, 108B, and 108C are similar in construction although their capacities may be different. The passive diffuser 112A may be a perforated pipe through which the fluid enters the tank 108A. Each of the hydration tanks 108A, 108B, and 108C is provided internally with alternating vertical baffles 114 that force the liquid through a back and forth pathway through the tank 108A, 108B, and 108C, as shown by the arrows, in FIG. 2. This causes a first in, first out flow pattern through the tanks 108A, 108B, and 108C and prevents the flow of liquid from short circuiting through the tanks 108A, 108B, and 108C. This flow pattern insures that the liquid gel achieves maximum and uniform retention and hydration time within the tank without allowing the gel to become so viscous that it can not be easily pumped. The liquid exits the second hydration tank 108A at an exit 116A located near the bottom 118 of the second hydration tank 108A and is pumped via a second centrifugal high sheer pump 94B to a second liquid flow line 96B.

The second liquid flow line 96B is provided with a second liquid flow meter 98B and intersects with the second dilution water line 38 where the liquid is again diluted with water supplied by the second dilution water line 38. The second dilution water line 38 receives water from the suction manifold 26. The water flowing through this second dilution water line 38 flows through a second water flow meter 100B, a second on/off butterfly valve 102B, and a second proportional valve 104B that controls the flow of water through the second dilution water line 38. The mixture of liquid from the second liquid flow line 96B and water from the second dilution water line 38 passes through a second static mixer 106B where the liquid and water are mixed to further dilute the liquid.

The mixture then enters the third hydration tank 108B via a second passive diffuser 112B that slows down the velocity of the fluid as it enters the third hydration tank 108B. The liquid flows through the baffled third hydration tank 108B to achieve maximum retention and hydration time within the third hydration tank 108B without allowing the gel to become so viscous that it can not be easily pumped. The liquid exits the third hydration tank 108B at a second exit 116B of the third hydration tank 108B and is pumped via a third centrifugal high sheer pump 94C to a third liquid flow line 96C.

The third liquid flow line 96C is provided with a third liquid flow meter 98C and intersects with the third dilution water line 40 where the liquid is again diluted with water supplied by a third water line 40. The third dilution water line 40 receives water from the suction manifold 26. The water flowing through this third dilution water line flows through a third water flow meter 100C, a third on/off butterfly valve 102C, and a third proportional valve 104C that controls the flow of water through the third dilution water line 40. The mixture of liquid from the third liquid flow line 96C and water from the third dilution water line 40 passes through a third static mixer 106C where the liquid and water are mixed to further dilute the liquid.

The mixture then enters the fourth hydration tank 108C via a third passive diffuser 112C that slows down the velocity of the fluid as it enters the fourth hydration tank 108C. The liquid flows through the baffled fourth hydration tank 108C to achieve maximum retention and hydration time within the fourth hydration tank 108C without allowing the gel to become so viscous that it can not be easily pumped. The liquid exits the fourth hydration tank 108C at a third exit 116C of the fourth hydration tank 108C into fourth liquid flow line 96D and is pumped via a fourth centrifugal high sheer pump 94D to the gel discharge manifold 24. Although not illustrated, the liquid gel then is pumped to a fracturing blender for addition of proppant and chemicals before the mixture is pumped into the well bore.

Progressive dilution of the gel in the first hydration tank 92 and the hydration tanks 108A, 108B, and 108C increases residence time of the gel in the tanks 92, 108A, 108B, and 108C and results in longer hydration time in the limited tank volume available. As a result, the present system 20 is able to continuously produce gel that is almost fully hydrated by the time it is transferred to the fracturing blender without the need for an increase in the volume of the hydration tanks.

The mix water flow meters 34A and 34B; the liquid flow meters 98A, 98B, 98C, and 98D; and the water flow meters 100A, 100B, and 100C all monitor flows in the system 20 so that the flows can be controlled by adjusting the proportional valves 104A, 104B, and 104C and by adjusting the pumping rate of the water pumps 30 and 32, thereby controlling the progressive dilution of the gel concentrate by the system 20.

Below is a comparison between a gel created employing the progressive dilution of the present system 20 and a gel created according to current mixing practice. In both cases, the feed rate into tank no. 1 is 67.2 lbs/min of guar powder diluted as shown below. Also, in both cases the output produced is forty (40) barrel per minute (bpm) or 1,680 gallons per minute (gpm) gel fluid at a final concentration of forty (40) lbs guar/1000 gal.

Gel Created Employing the Progressive Dilution of the Present System

| | Tank No. | | | |
|---|---|---|---|---|
| | 1 | 2 | 3 | 4 |
| Tanks size | 25 bbl | 25 bbl | 25 bbl tank | 25 bbl |
| Gel powder added | 67.2 lbs/min | 0 | 0 | 0 |
| Water added | 10 bpm | 10 bpm | 10 bpm | 10 bpm |
| Net throughput rate | 10 bpm | 20 bpm | 30 bpm | 40 bpm |
| Residence time | 2.5 min. | 1.25 min. | 0.83 min. | 0.62 min. |

Total residence/hydration time achieved with progressive dilution = 5.2 min.

Gel Created Employing Current Mixing Practice

| | Tank No. | | | |
|---|---|---|---|---|
| | 1 | 2 | 3 | 4 |
| Tanks size | 25 bbl | 25 bbl | 25 bbl tank | 25 bbl |
| Gel powder added | 67.2 lbs/min | 0 | 0 | 0 |
| Water added | 40 bpm | 0 bpm | 0 bpm | 0 bpm |
| Net throughput rate | 40 bpm | 40 bpm | 40 bpm | 40 bpm |
| Residence time | 0.62 min. | 0.62 min. | 0.62 min. | 0.62 min. |

Total residence/hydration time achieved with current dilution practice = 2.5 min.

For simplification of the examples presented above, the hydration tanks are all shown as equal in size. Hydration tanks do not need to be equal sizes and the dilution amount for each tank does not need to be the same. Individual tank volumes can be adjusted in size to optimize the process. However, the total dilution throughout the process should be the same to create the end desired concentration. Although equal dilution amounts make control of the system easier, if the process is slowed due to well conditions, hydration might proceed too fast in the first tanks. To counter this, faster dilution, i.e. more dilution in first tanks and less dilution in the downstream tanks, would reduce the potential problem. Actually, a control plan can be developed such that the same amount of hydration is developed regardless of the throughput rate. This presents a more complicated control issue, but it should not be a problem with the use of current computers to operate the controls.

Thus, as the foregoing example illustrates, progressive dilution of gel according to the present system 20 allows the hydration time of guar gel to be increased by more than double without changing the capacity of the tanks 92, 108A, 108B, and 108C used for hydration. In more than doubling the hydration time using existing tank capacity, and by employing centrifugal high sheer pumps 94A, 94B, 94C, and 94D between the tanks 92, 108A, 108B, and 108C that are used for hydration, thus increasing the normal hydration rate, this system 20 produces gel that is more fully hydrated than can be achieved with other gel mixing and hydration systems currently used in the industry.

FIGS. 11-13 illustrate two different methods of control for the present system 20. FIG. 11 shows an example of an initial system with a constant 50 bpm throughput at a guar concentration 35 lb/100 gal of water. This example utilizes four dilution tanks with each tank having a capacity of 40 barrels. The guar feed rate for this concentration is 73.b lb/min, and the estimated 100% hydration viscosity for the resulting mixture is 33 cp.

Both FIGS. 12 and 13 show the same system as illustrated in FIG. 11 when the throughput has been reduced to 30 bpm, but FIGS. 12 and 13 illustrated two different methods of controlling the progressive dilution of gel according to the present system 20.

FIG. 12 illustrates control of the system 20 so that the original concentration is maintained in all dilution tanks despite the reduction in throughput, and FIG. 13 illustrates control of the system 20 so that the original total hydration time is maintained.

The control illustrated in FIG. 12, i.e. control so that the original concentration is maintained in all dilution tanks, is accomplished by proportionally changing the dilution in all of the dilution tanks simultaneously whenever there is a change in the throughput. Although this method of control has the advantage of simplicity of control, the method has the disadvantage that the end gel strength will change over the original due to greater residence time within the dilution tanks and the viscosity within the first and possibly the second tank may become too high to be easily pumped when the mixing rates are low.

The control illustrated in FIG. 13, i.e. control so that the original total hydration time is maintained for the system, is accomplished by use of viscometer readings and computer to control the change in dilution is the series of dilution tanks so that the total hydration time is maintained the same as before the change in throughput occurred. Although this method of control has the disadvantages of more complex control and the possible problem of fluctuating output concentration during transition from one throughput rate to another if not properly controlled, the method has the advantage that the end viscosity does not change very much over the original condition before the throughput change. This method will give the most consistent fluid characteristics for well fracturing treatment, particularly when the fluid is cross-linked.

Each of these control methods has advantages and disadvantages in controlling the progressive dilution of gel in the system 20.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A gel mixing system comprising:

a gel mixer;

a dynamic diffuser in fluid communication and immediately downstream of said gel mixer;

a rotatable impeller located within said dynamic diffuser, said impeller positioned within a first flow channel, said first flow channel receiving fluid from said gel mixer;

at least one hydration tank in fluid communication with said dynamic diffuser.

2. A gel mixing system according to claim 1, wherein the dynamic diffuser further comprises:

an inlet provided in the top of the dynamic diffuser tank communicating with the first flow channel by which liquid gel from the gel mixer enters the first channel;

an internal partition wall located within said dynamic diffuser, said partition wall defines second and third flow channels, wherein said second flow channel is in fluid communication with the lower portion of said first flow channel and the third flow channel is in fluid communication with the upper portion of said second flow channel;

a liquid exit provided at the bottom of the dynamic diffuser tank; and, an air exit opening provided at the top of the second channel.

3. The gel mixing system of claim 1, further comprising at least one centrifugal pump in fluid communication with said diffuser and at least one hydration tank.

4. A gel mixing system according to claim 1, wherein the impeller is a high speed impeller.

5. The gel mixing system of claim 1, further comprising:

at least one fluid flow meter in fluid communication with at least one hydration tank and at least one centrifugal pump in fluid communication with said diffuser, said hydration tank and said fluid flow meter.

6. A gel mixing system according to claim 1, further comprising:

an impeller cylinder wherein said impeller cylinder defines said first flow channel.

7. A gel mixing system according to claim 6, wherein the impeller cylinder comprises:

a stationary upper portion secured to the dynamic diffuser and a lower portion secured to the impeller.

8. A gel mixing system according to claim 7, wherein the dynamic diffuser further comprises:

an impeller motor, said impeller motor functionally attached to said impeller.

9. A gel mixing system according to claim 8 wherein the dynamic diffuser further comprises:

fins provided on a lower end of the impeller shaft, said fins attached to a flared lower portion of the impeller cylinder, and a bottom plate attached to the lower end of the impeller shaft, and a set of bearings supporting the bottom plate above a bottom of the dynamic diffuser tank.

10. A gel mixing system according to claim 7, further comprising a bearing provided between said stationary upper portion and the lower portion of said impeller cylinder.

11. The gel mixing system of claim 1, wherein said impeller is centrally located within said dynamic diffuser.

12. The gel mixing system of claim 11, further comprising:

at least one fluid flow meter in fluid communication with at least one hydration tank and at least one centrifugal pump in fluid communication with said diffuser, said hydration tank and said fluid flow meter.

13. The gel mixing system of claim 11, wherein said impeller is centrally located within said dynamic diffuser.

14. A gel mixing system comprising:

a gel mixer;

a dynamic diffuser in fluid communication and immediately downstream of said gel mixer, located within said dynamic diffuser is a rotatable impeller, said impeller being located within an impeller cylinder wherein said cylinder forms a first flow channel, said first flow channel receiving fluid from said gel mixer;

an inlet carried by said dynamic diffuser, said inlet receiving fluid from said gel mixer and directing said fluid to said first flow channel;

an internal partition wall located within said dynamic diffuser, said partition wall defines second and third flow channels, wherein said second flow channel is in fluid communication with the lower portion of said first flow channel and the third flow channel is in fluid communication with the upper portion of said second flow channel;

a liquid exit carried by the bottom of said dynamic diffuser and an air exit carried by the top of said dynamic diffuser;

a series of hydration tanks wherein at least one hydration tank is in fluid communication with said dynamic diffuser.

15. The gel mixing system of claim 14, further comprising at least one centrifugal pump in fluid communication with said diffuser and at least one hydration tank.

16. A gel mixing system according to claim 14, wherein the impeller is a high speed impeller.

17. A gel mixing system according to claim 14, wherein the impeller cylinder further comprises:

a stationary upper portion secured to the dynamic diffuser;

a lower portion secured to the impeller.

18. A gel mixing system according to claim 17, further comprising a bearing provided between said stationary upper portion and the lower portion of said impeller cylinder.

19. A gel mixing system according to claim 14, wherein the dynamic diffuser further comprises:

an impeller motor, said impeller motor drivably connected to said impeller.

* * * * *